US006672840B2

(12) United States Patent
Jung et al.

(10) Patent No.: US 6,672,840 B2
(45) Date of Patent: Jan. 6, 2004

(54) FAN FOR CONDENSER OF REFRIGERATOR

(75) Inventors: Young-gyu Jung, Inchun-si (KR); Chang-joon Kim, Seoul (KR); Seung-jo Baek, Gwangmyung-si (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 10/024,295

(22) Filed: Dec. 21, 2001

(65) Prior Publication Data

US 2002/0127110 A1 Sep. 12, 2002

(30) Foreign Application Priority Data

Jan. 11, 2001 (KR) ..... 10-2001-1532
Feb. 23, 2001 (KR) ..... 10-2001-9315

(51) Int. Cl.[7] ..... F04D 29/38
(52) U.S. Cl. ..... 416/238; 416/223 R; 416/DIG. 2

(58) Field of Search ..... 416/243, 223 R, 416/238, DIG. 2, DIG. 5; 62/428, 429

(56) References Cited

U.S. PATENT DOCUMENTS 6,394,754 B1 * 5/2002 Choi ..... 416/238

* cited by examiner

*Primary Examiner*—Edward K. Look
*Assistant Examiner*—Kimya N McCoy
(74) *Attorney, Agent, or Firm*—Birch, Stewart, Kolasch & Birch, LLP

(57) ABSTRACT

The invention relates to an axial flow fan for condenser in a refrigerator for enhancing efficiency and lowering noise, in which the number of blades is three, the diameter of a hub is 23.3±5% of the outside diameter of the axial flow fan and the width of each of the blades is 36.6±3% of the outside diameter of the axial flow fan.

8 Claims, 8 Drawing Sheets

FAN FOR CONDENSER OF REFRIGERATOR

BACKGROUND OF THE INVENTION

1. Field of the Invention

The present invention relates to a refrigerator, and more particularly, to an axial flow fan for condenser for reducing flow noise in a refrigerator.

2. Description of the Related Art

In general, a refrigerator in use for freezing or cooling foods includes a housing for defining receiver spaces therein divided into freezer and refrigerator compartments, upper and lower doors installed in one side of the housing for opening/shutting the freezer and refrigerator compartments and instruments which include a compressor, a condenser and an evaporator for carrying out a cooling cycle for cooling the freezer and refrigerator compartments.

In such a refrigerator, a gaseous refrigerant in low temperature and pressure is compressed to have a high temperature and pressure by a compressor. The compressed hot and high-pressure gaseous refrigerant is cold compressed to a high-pressure liquid while passing through a condenser. The high-pressure refrigerant is lowered in temperature and pressure while passing through capillaries, and consequently absorbs heat from the surrounding to cool the neighboring air in the evaporator while being converted to a gas having a low temperature and pressure. The cold air cooled via the evaporator is circulated into the freezer and refrigerator compartments through the operation of a blower fan so that the freezer and refrigerator compartments are lowered in temperature.

In a refrigerator as shown in FIG. 1, a condenser 10 and a compressor 12 are installed in a so-called machine room in the outer bottom of a housing, and a blower fan assembly is arranged in one side thereof for absorbing the outer air into the machine room and flowing the same toward the condenser 10 to effectively cool a refrigerant introduced into the condenser 10.

The blower fan assembly is comprised of an axial flow fan 20 and a motor 22 for driving the axial flow fan 20, in which the axial flow fan 20, as shown in FIG. 2, is constituted by a hub 201 connected to the rotation axis of the motor 22 and a number of blades 202 arranged in the outer periphery of the hub 201.

According to the blower fan assembly, the axial flow fan 20 is rotated through operation of the motor 22 to cause the pressure difference between the front and rear surfaces of the blades 202. This pressure difference causes the outer air to be flown into the machine room and then toward the condenser 10.

Examples of characteristic factors for determining the blowing characteristics of such an axial flow fan 20 include a sweep angle, the maximum camber amount, the number of the blades 202 and the like. The sweep angle, as shown in FIG. 2, means an angle $\alpha$ defined by the Y axis and a line passing the center of the inner side of the blade 202 and the center of the hub 201, in which the Y axis is a line that connects between the center of the inner side of the blade 202 or the center of a portion of the blade contacting with the hub 201 and the center of the outer side or tip of the blade.

Also, as shown in FIG. 2B, the maximum camber amount p means the straight length between a chord connecting the leading edge L. E. and a trailing edge T. E. of the blade 202 and the maximum camber position P.

In this case, the sweep angle $\alpha$ is a factor for determining flow noise of the axial flow fan 20, a large value of the sweep angle $\alpha$ increases the phase difference of airflow between the hub 201 and the tip of the blade 202 whereas a small amount of sweep angle $\alpha$ decreases the phase difference of the airflow.

For example, comparing two axial flow fans with the same blade number and blowing amount, a blade with a sweep angle of 30°, as shown in FIG. 3A, allows an airflow to pass through the blade during rotation thereof for about 23° whereas a blade with a sweep angle of 60°, as shown in FIG. 3B, allows an airflow to pass through the blade during rotation thereof for about 49°.

In other words, according to the sweep angle $\alpha$, the airflow passing the outer end or tip of the blade has the phase difference of 23° and the airflow passing the inner end of the blade has the phase difference of 49°.

Therefore, such a phase difference of the airflow causes a phase difference between noises from the outer end of the blade 202 and from the inner end thereof, in which the frequency passing through the blade decreases as the phase difference is larger.

The maximum camber amount p is a factor for determining the pressure difference between the upper and lower surfaces of the blade 202, in which increment of the maximum camber amount p increases the pressure difference between the upper and lower surfaces thereby increasing the blade-passing frequency also.

Meanwhile, according to the structure of the machine room with a simple passage and a small value of passage resistance, it is efficient that the axial flow fan 20 is configured to have a low level of noise even if a blowing pressure is more or less low rather than the blowing pressure is high. However, the axial flow fan 20 applied to a conventional blower fan assembly has a configuration in which a space between the blades 202 is narrow and the sweep angle $\alpha$ is small whereas the camber amount is large and the number of the blades 202 is three.

Since the narrow space between the blades 202 resultantly causes the blades 202 to be large sized, the airflow generated on the surface of the blades 202 may have a large peeling range and a large pressure-fluctuating range, which are reasons for increasing flow noise. Further, the sweep angle $\alpha$ is small and the maximum camber amount p is large so that flow noise is increased due to the foregoing characteristics of the sweep angle and the maximum camber amount.

Therefore, the axial fan for condenser in the refrigerator of the related art has loud flow noise thereby degrading the performance of the refrigerator as a problem.

SUMMARY OF THE INVENTION

Accordingly, the present invention has been devised to solve the foregoing problems of the related art and therefore it is an object of the invention to provide an axial flow fan for condenser in a refrigerator, the axial flow fan comprising three blades, wherein the diameter of a hub is 23.3±5% of the outside diameter of the axial flow fan and the width of each of the blades is 36.6±3% of the outside diameter of the axial flow fan.

Also, in order to obtain the foregoing object of the invention, it is provided an axial flow fan for condenser in a refrigerator, the axial flow fan comprising three blades, wherein the ratio of the inside diameter to the outside diameter is 23.0±5%, the maximum camber position is 0.65 uniformly distributed from the hub to the tip, and the maximum camber has curved distributions of 4.0 to 5.0% from the hub to the maximum camber position and of 5.0 to 6.0% from the maximum camber position to the tip.

DETAILED DESCRIPTION OF THE PREFERRED EMBODIMENT

Figure 1:
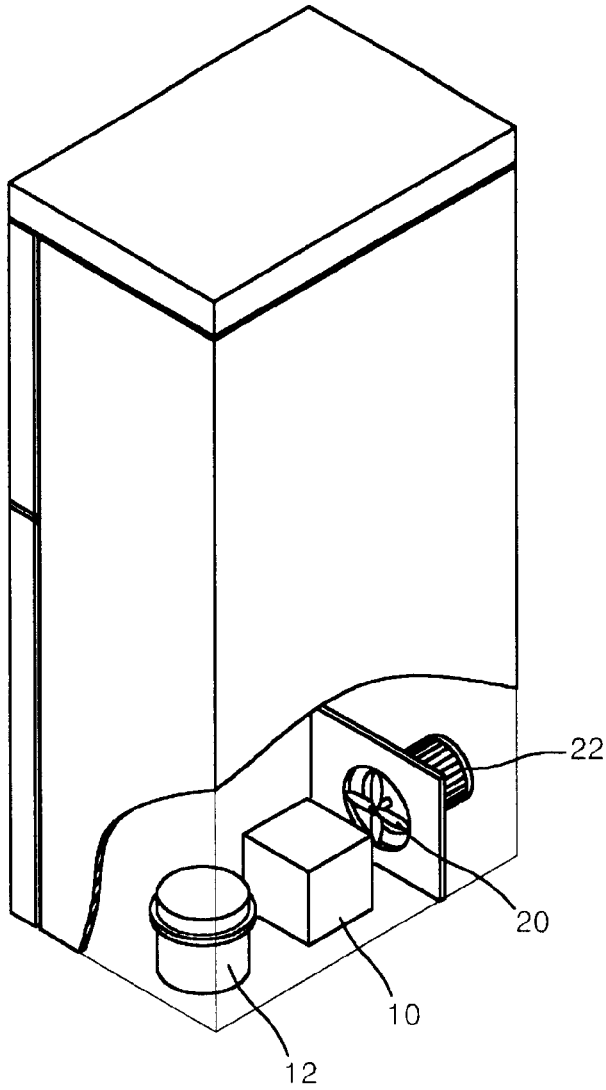
FIG. 1 is a perspective view for showing the structure of a machine room of a general refrigerator.
Figure 2A:
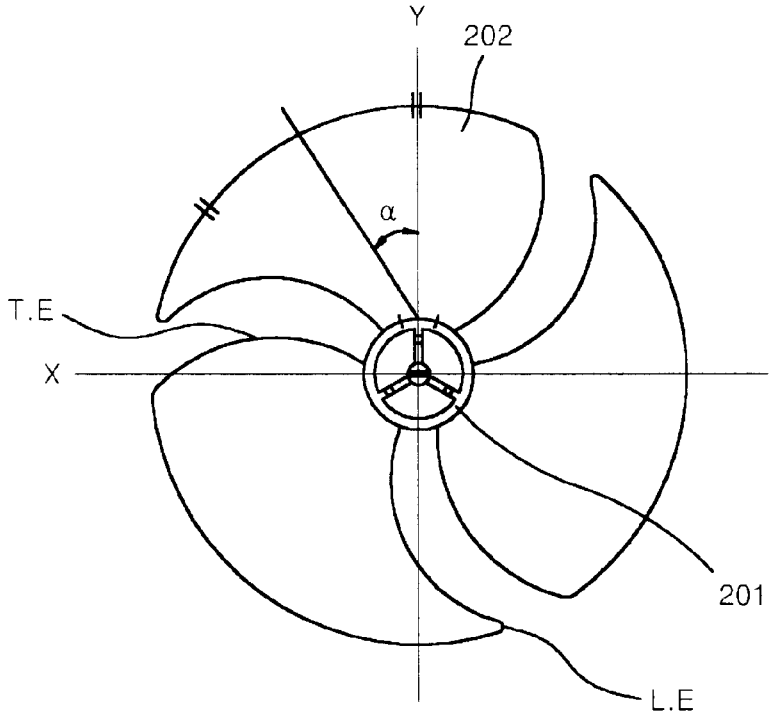
FIGS. 2*an* and 2B are plan and side elevation views for showing characteristic factors of an axial flow fan constituting a general blower fan assembly.
Figure 2B:
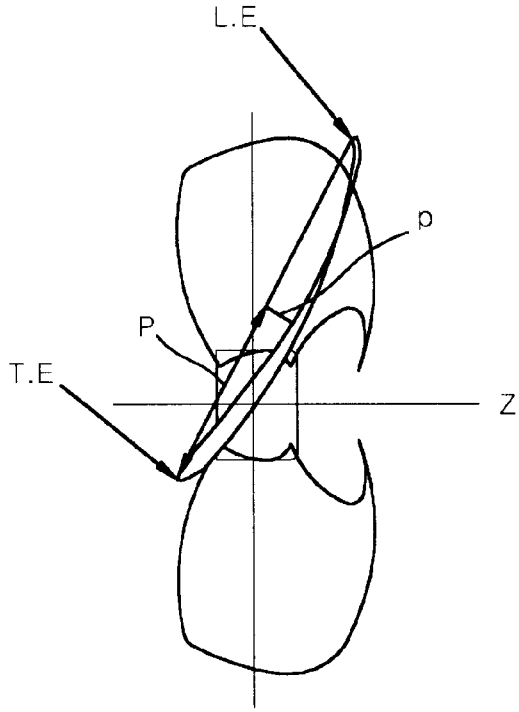
Figure 3A:
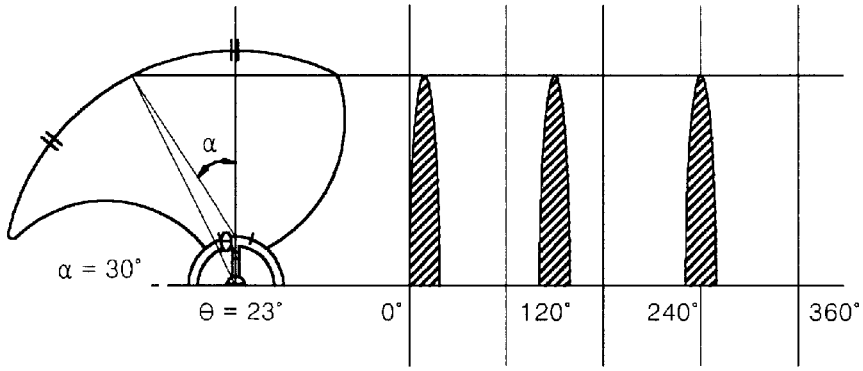
FIGS. 3*an* and 3B are graphs for showing the phase difference of airflows according to sweep angles of characteristic factors of axial flow fans.
Figure 3B:
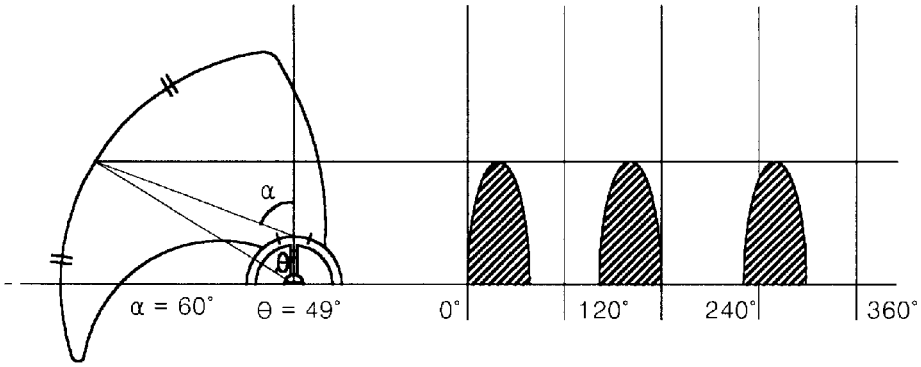

Hereinafter detailed description will be made about the invention in reference to the accompanying drawings as follows.

In order to obtain the foregoing object of the invention, provided is an axial flow fan for condenser in a refrigerator, characterized in that the number of blades is three, the diameter of a hub is 23.3±5% of the outside diameter of the axial flow fan and the width of each of the blades is 36.6±3% of the outside diameter of the axial flow fan.

The axial flow fan of the invention is characterized in that the outside diameter of the axial flow fan is 150±1 mm, the diameter of the hub is 35±1 mm, and the width of the blade is 55±1 mm.

Also, the axial flow fan of the invention is characterized in that the each blade has the maximum camber position of 0.65 which is uniformly distributed from the hub to the tip, wherein the maximum camber has curved distributions of 4.0 to 5.0% from the hub to the maximum camber position and of 5.0 to 6.0% from the maximum camber position to the tip, and that the each blade has a pitch angle of 36.0 to 26.0° from the hub to the tip defining a linear distribution, and a sweep angle of 67.0°±5%.

Hereinafter, detailed description will be made about the first embodiment of the invention in reference to FIGS. 4 to 7, in which the same reference numerals will be designated to the elements of the invention similar to those of the related art.

Figure 4A:
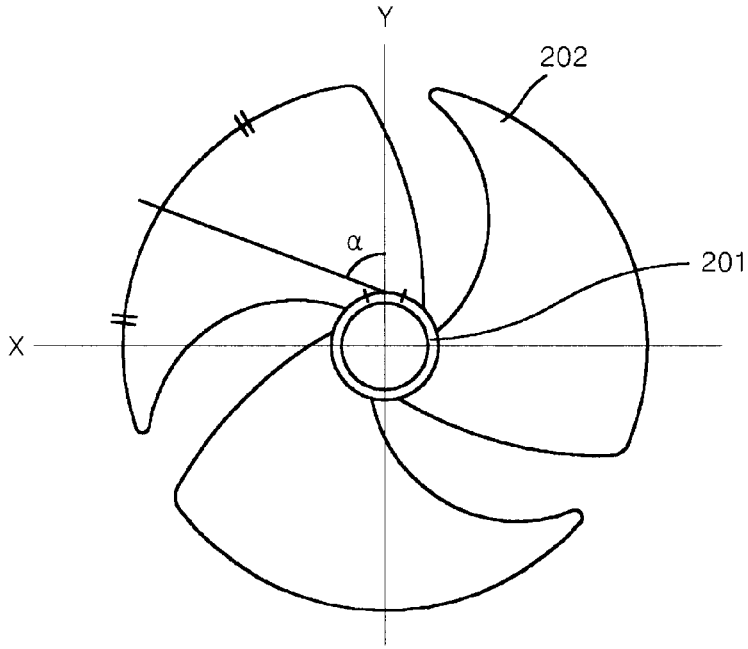
FIGS. 4*an* and 4B are plan and side elevation views for showing characteristic factors of an axial flow fan for condenser according to the invention.
Figure 4B:
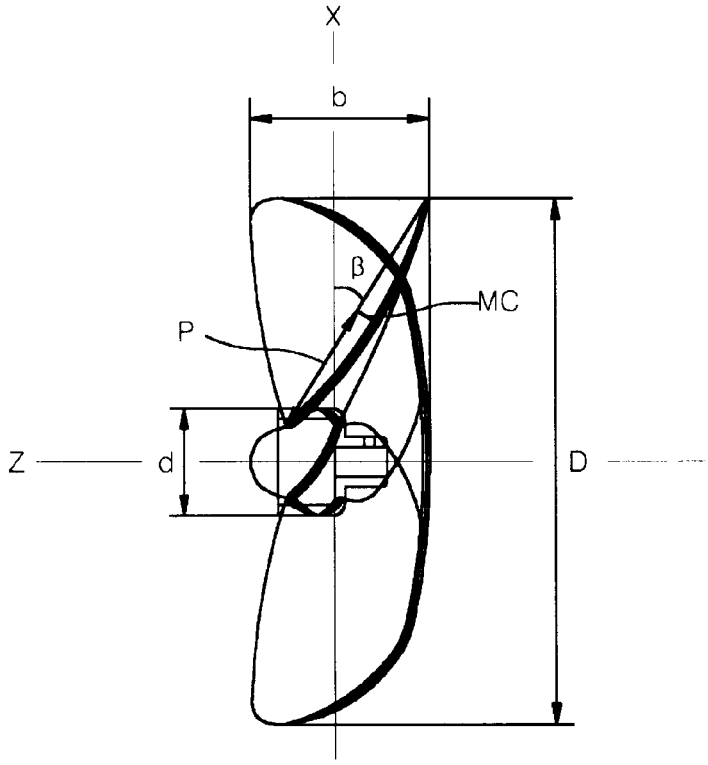

First, an axial flow fan for condenser in a refrigerator according to the first embodiment of the invention is configured to have three blades 202 as shown in FIG. 4A, in which the diameter d of a hub is 23.3±5% of the outside diameter D of the axial flow fan and the width b of each of the blades is 36.6±3% of the outside diameter D of the axial flow fan as shown in FIG. 4B.

In this case, it is preferable that the outside diameter D of the axial flow fan, the diameter d of the hub and the width b of the blade are respectively sized to satisfy the foregoing ratios such as 150±1 mm, 35±1 mm and 55±1 mm considering the volume of a machine room.

Figure 5:
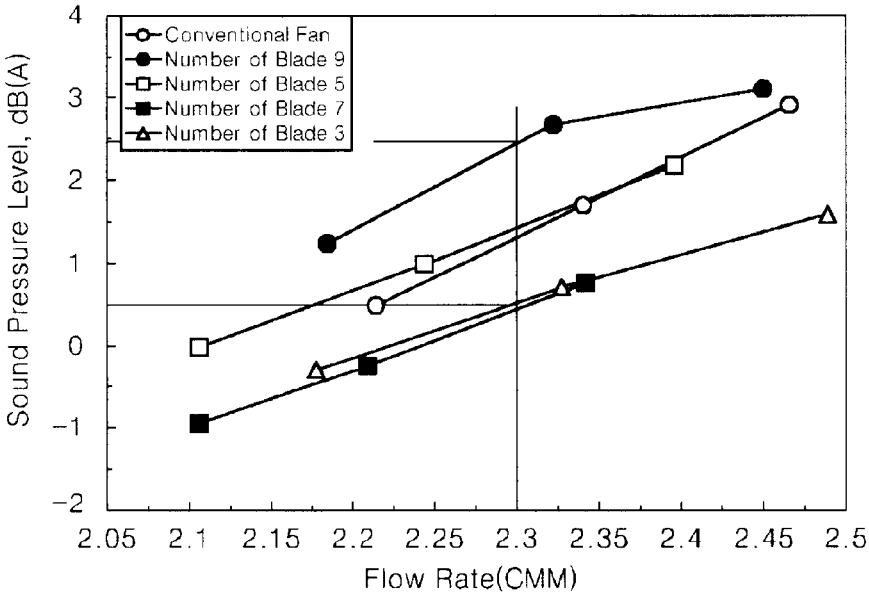
FIG. 5 is a graph for showing noise variation according to the number of blades of characteristic factors of an axial flow fan according to the invention.

Those magnitudes are selected as a result of experiments, which were made to axial flow fans with 3, 5, 7 and 9 blades in order to compare flow noise according to the number of blades. As shown in FIG. 5, flow noise has the smallest level in the axial flow fan where the number of the blades is 3 or 7.

Further, comparing the fan with 3 blades to the fan with 7 blades, the fan with 3 blades is more smooth in rate of increment and higher in convenience of manufacture and thus more excellent in the performance and manufacturing conditions.

Figure 6:
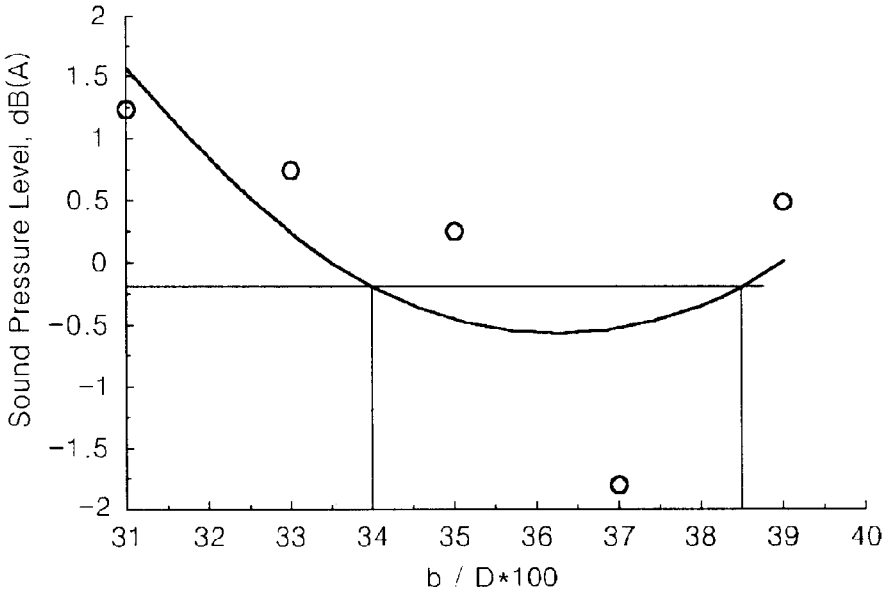
FIG. 6 is a graph for showing noise variation according to blade widths of characteristic factors of an axial flow fan according to the invention.

The blade width b is also an important factor for determining flow noise in the passage closed in the axial direction of the axial flow fan such as the machine room of the refrigerator, and as shown in FIG. 6, it can be seen that flow noise has the smallest value when the ratio of the blade width b is 36.6% about the outside diameter D of the axial flow fan.

Further, according to the first embodiment of the invention, the axial flow fan has a configuration in which the maximum camber position P of the each blade 202 is 0.65 uniformly distributed from the hub 201 to the tip, the maximum camber MC shows curved distributions of 4.0 to 5.0% from the hub 201 to the maximum camber position P and of 5.0 to 6.0% from the maximum camber position P to the tip, a pitch angle $\beta$ is 36.0 to 26.0° from the hub 201 to the tip showing a linear distribution, and a sweep angle $\alpha$ is 67.0°±5%.

Figure 7:
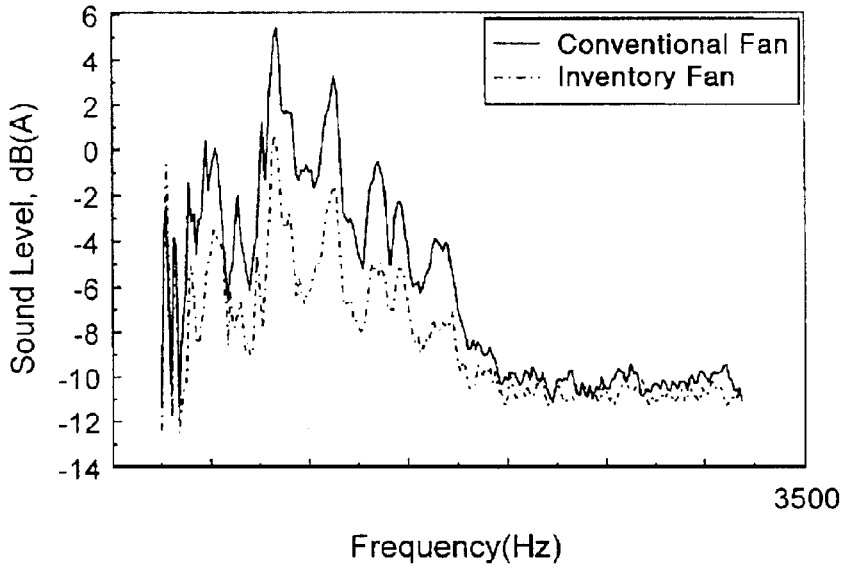
FIG. 7 is a graph for showing noise spectra of axial flow fans of the invention and the related art.

Therefore, according to the first embodiment of the invention, the fan has a rotation velocity increased of about 50 rpm and noise decreased of about 2 dB as shown in FIG. 7 under the condition that the airflow is the same as the conventional axial flow fan.

According to the blower fan for condenser in the refrigerator of the invention as described hereinbefore, the flow noise and the blade-passing frequency are reduced due to the factor characteristics such as the number and the maximum camber of the blade and the width rate of the blade about the outside diameter of the axial flow fan so that the refrigerator is advantageously improved in performance.

Hereinafter detailed description will be made about an axial flow fan for a refrigerator according to the second embodiment of the invention in reference to the accompanying drawings and a table as follows.

As shown in FIG. 5, it can be seen that noise from the axial flow fan is reverse proportional to the number of the blades at the same blowing amount. This means that increment of the number of the blades as the most important factor for overcoming passage resistance is the most important factor in increment of noise in blowing.

Therefore, it is preferable in regard of noise to apply an axial flow fan with fewer blades as long as the amount of airflow is not reduced in a great amount.

Figure 8:
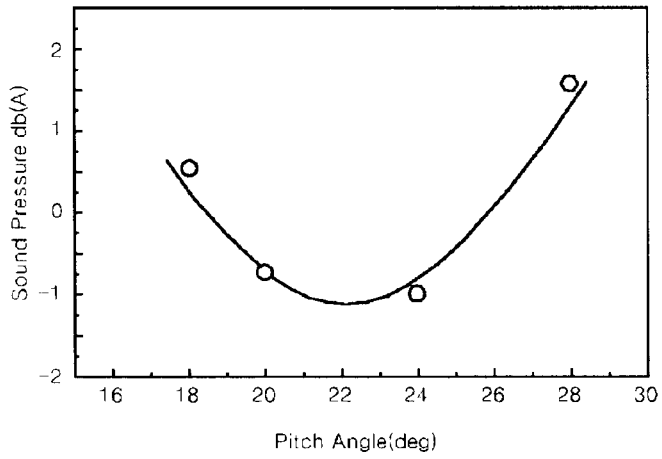
FIG. 8 is a graph for showing noise variation of an axial flow fan according to variation of pitch angle of the invention.

FIG. 8 is a graph for showing noise variation in the axial flow fan according to variation of the pitch angle, which is a result of experiments about an axial flow fan with three blades based upon the result in FIG. 5, in which the vertical axis indicates sound pressure and the horizontal axis indicates pitch angle.

The pitch angles shown in FIG. 8 are values at the tip, in which noise is reverse-proportional to increment of the pitch angle and then proportional to increment of the pitch angle when the value of the pitch angle increases beyond a certain range. In this case, the pitch angle ranges 20 to 25° to have the lowest level of noise.

Figure 9:
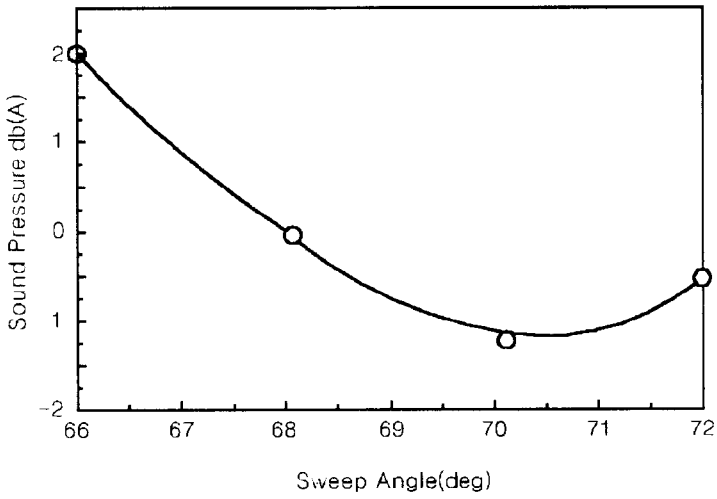
FIG. 9 is a graph for showing noise variation of an axial flow fan according to variation of sweep angles of the invention.

FIG. 9 is a graph for showing the variation of noise in the axial flow fan according to the variation of the sweep angle, in which the vertical axis indicates sound pressure and the horizontal axis indicates the sweep angle at the tip.

The sweep angle indicates the degree of inclination of the blade in the rotating direction, which is the angle defined by imaginary lines connecting from the hub to the center of the blade and from the tip to the center of the blade together with a line perpendicular to the rotation angle. The sweep angle for reducing noise of the fan has a value of 0 at the hub and a certain value at the tip according to a function.

As shown in FIG. 9, it can be seen that noise is minimized when the sweep angle is 69 to 72° at the tip.

Meanwhile, description will be made as follows about the optimal axial flow fan for the refrigerator according to the second embodiment of the invention which can minimize noise based upon noise variation about foregoing factors such as the number of blades, the pitch angle and the sweep angle.

First, as shown in FIGS. 4*an* and 4B, the axial flow fan 20 for the refrigerator according to the second embodiment of the invention is comprised of the hub 201 coupled to the rotation axis of the motor and the 3 blades 202 radially provided in the outer periphery of the hub for blowing the air through rotation thereof.

Each of the blades 202 is an element for incurring airflows, and the three dimensional contour of the each blade is defined by several factors for determining the flow characteristics of the axial flow fan.

According to the second embodiment of the invention, the hub diameter d of the axial flow fan is 23.0±5% of the outside diameter D of the fan, in which practically the rotation diameter D of the axial flow fan is 110±1 mm, the hub diameter d is 25±1 mm and the blade width b of the axial flow fan is 36.0±1 mm.

According to the second embodiment of the invention, the maximum camber position P of the axial flow fan 20 is 0.65 uniformly distributed from the hub 21 to the tip, and the maximum camber MC has curved distributions of 4.0 to 5.0% from the hub to the maximum camber position P and of 5.0 to 6.0% from the maximum camber position to the tip.

Also, the pitch angle β of the axial flow fan has a linear distribution of 35.0 to 24.0° from the hub 201 to the tip. In this case, the optimal value is selected as the pitch angle β from the range of 20 to 25° where noise is minimized from the result of FIG. 4.

The sweep angle α of the axial flow fan according to the second embodiment of the invention has a value of 72.0°±10% from the tip. This is selected to satisfy the range of 69 to 72° where noise is minimized from the result of FIG. 5. In other words, the sweep angle α the axial flow fan 20 is much larger than the sweep angle of the conventional axial flow fan so that the axial flow fan 20 can minimize interference in flowing with other components located in the rear of the axial flow fan 20 including the condenser thereby reduce noise in a great amount.

The axial flow fan 20 configured as above can have both of clockwise and counterclockwise rotation directions.

Meanwhile, boundary data of the blade 202 constituting the axial flow fan will be described in reference to the drawings and the table as follows.

Figure 10:
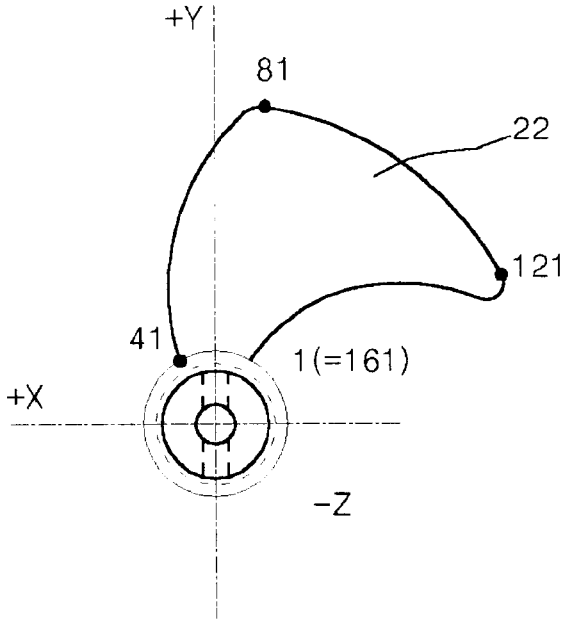
FIG. 10 is a sectional view for an axial flow fan for a refrigerator of the invention in which the boundary of a blade is divided into 160 areas for illustration.

First, FIG. 10 is a sectional view of the axial flow fan for the refrigerator of the invention for illustrating the boundary of blade in 160 areas, in which the boundary of the blade 202 is divided into 160 areas and then the position of each area is displayed with three coordinates X, Y and Z to show a three-dimensional configuration.

As shown in FIG. 10, the blade 202 is divided into 160 areas in clockwise sequence from the hub-side front 1 via the hub-side rear 41, the tip-side rear and the tip-side front 121 to the hub-side front 161 again, in which the coordinates of the each area are as in the following table. In this case, the X coordinates indicate the horizontal axis, the Y coordinates indicate the vertical axis and the Z coordinates indicate the rotation axis, in which the boundary value of the each area has a unit of mm.

TABLE 1

| No | X | Y | Z |
|---|---|---|---|
| 1 | −9.368 | 8.276 | −6.559 |
| 2 | −9.341 | 8.307 | −6.544 |
| 3 | −9.261 | 8.396 | −6.5 |
| 4 | −9.129 | 8.539 | −6.426 |
| 5 | −8.945 | 8.731 | −6.323 |
| 6 | −8.711 | 8.965 | −6.19 |
| 7 | −8.423 | 9.236 | −6.026 |
| 8 | −8.084 | 9.534 | −5.831 |
| 9 | −7.691 | 9.854 | −5.605 |
| 10 | −7.245 | 10.186 | −5.345 |
| 11 | −6.746 | 10.523 | −5.053 |
| 12 | −6.196 | 10.857 | −4.729 |
| 13 | −5.595 | 11.178 | −4.373 |
| 14 | −4.948 | 11.479 | −3.988 |
| 15 | −4.257 | 11.753 | −3.574 |
| 16 | −3.527 | 11.992 | −3.136 |
| 17 | −2.763 | 12.191 | −2.677 |
| 18 | −1.972 | 12.343 | −2.199 |
| 19 | −1.16 | 12.446 | −1.709 |
| 20 | −0.335 | 12.496 | −1.21 |
| 21 | 0.495 | 12.49 | −0.707 |
| 22 | 1.324 | 12.43 | −0.206 |
| 23 | 2.138 | 12.316 | 0.293 |
| 24 | 2.924 | 12.153 | 0.8 |
| 25 | 3.673 | 11.948 | 1.309 |
| 26 | 4.381 | 11.707 | 1.817 |
| 27 | 5.045 | 11.437 | 2.318 |
| 28 | 5.662 | 11.144 | 2.809 |
| 29 | 6.23 | 10.837 | 3.284 |
| 30 | 6.748 | 10.522 | 3.742 |
| 31 | 7.216 | 10.207 | 4.177 |
| 32 | 7.634 | 9.898 | 4.586 |
| 33 | 8.005 | 9.601 | 4.966 |
| 34 | 8.328 | 9.322 | 5.314 |
| 35 | 8.605 | 9.066 | 5.625 |
| 36 | 8.838 | 8.839 | 5.898 |
| 37 | 9.028 | 8.645 | 6.128 |
| 38 | 9.176 | 8.489 | 6.312 |
| 39 | 9.282 | 8.372 | 6.447 |
| 40 | 9.346 | 8.301 | 6.531 |
| 41 | 9.368 | 8.276 | 6.559 |
| 42 | 9.192 | 9.972 | 6.643 |
| 43 | 8.952 | 11.565 | 6.753 |
| 44 | 8.671 | 13.073 | 6.89 |
| 45 | 8.368 | 14.51 | 7.049 |
| 46 | 8.053 | 15.888 | 7.225 |
| 47 | 7.734 | 17.218 | 7.412 |
| 48 | 7.417 | 18.506 | 7.603 |
| 49 | 7.106 | 19.761 | 7.789 |
| 50 | 6.804 | 20.987 | 7.975 |
| 51 | 6.512 | 22.189 | 8.173 |

TABLE 1-continued

| No | X | Y | Z |
|---|---|---|---|
| 52 | 6.233 | 23.371 | 8.382 |
| 53 | 5.968 | 24.535 | 8.602 |
| 54 | 5.698 | 25.688 | 8.823 |
| 55 | 5.407 | 26.836 | 9.035 |
| 56 | 5.095 | 27.977 | 9.237 |
| 57 | 4.76 | 29.114 | 9.43 |
| 58 | 4.402 | 30.244 | 9.613 |
| 59 | 4.023 | 31.368 | 9.786 |
| 60 | 3.621 | 32.486 | 9.95 |
| 61 | 3.196 | 33.598 | 10.103 |
| 62 | 2.748 | 34.704 | 10.247 |
| 63 | 2.277 | 35.803 | 10.382 |
| 64 | 1.783 | 36.894 | 10.506 |
| 65 | 1.266 | 37.979 | 10.621 |
| 66 | 0.726 | 39.056 | 10.726 |
| 67 | 0.162 | 40.125 | 10.821 |
| 68 | −0.426 | 41.185 | 10.906 |
| 69 | −1.067 | 42.237 | 10.967 |
| 70 | −1.798 | 43.275 | 10.986 |
| 71 | −2.621 | 44.298 | 10.963 |
| 72 | −3.534 | 45.3 | 10.9 |
| 73 | −4.537 | 46.278 | 10.797 |
| 74 | −5.63 | 47.228 | 10.656 |
| 75 | −6.812 | 48.146 | 10.477 |
| 76 | −8.081 | 49.026 | 10.187 |
| 77 | −9.437 | 49.865 | 9.688 |
| 78 | −10.88 | 50.657 | 8.893 |
| 79 | −12.44 | 51.39 | 7.774 |
| 80 | −15.35 | 51.709 | 5.006 |
| 81 | −19.85 | 51.295 | −1.122 |
| 82 | −19.96 | 51.25 | −1.293 |
| 83 | −20.3 | 51.116 | −1.665 |
| 84 | −20.85 | 50.894 | −2.224 |
| 85 | −21.6 | 50.58 | −2.954 |
| 86 | −22.54 | 50.168 | −3.837 |
| 87 | −23.65 | 49.654 | −4.854 |
| 88 | −24.93 | 49.028 | −5.984 |
| 89 | −26.34 | 48.281 | −7.203 |
| 90 | −27.89 | 47.405 | −8.485 |
| 91 | −29.55 | 46.389 | −9.807 |
| 92 | −31.3 | 45.225 | −11.15 |
| 93 | −33.13 | 43.906 | −12.49 |
| 94 | −.35 | 42.423 | −13.8 |
| 95 | −36.91 | 40.773 | −15.07 |
| 96 | −38.83 | 38.953 | −16.28 |
| 97 | −40.73 | 36.962 | −17.39 |
| 98 | −42.59 | 34.805 | −18.41 |
| 99 | −44.38 | 32.485 | −19.31 |
| 100 | −46.09 | 30.017 | −20.09 |
| 101 | −47.67 | 27.442 | −20.8 |
| 102 | −49.1 | 24.783 | −21.47 |
| 103 | −50.38 | 22.064 | −22.07 |
| 104 | −51.5 | 19.307 | −22.61 |
| 105 | −52.46 | 16.537 | −23.08 |
| 106 | −53.25 | 13.778 | −23.49 |
| 107 | −53.88 | 11.056 | −23.82 |
| 108 | −54.36 | 8.395 | −24.1 |
| 109 | −54.69 | 5.819 | −24.31 |
| 110 | −54.9 | 3.351 | −24.48 |
| 111 | −54.99 | 1.012 | −24.61 |
| 112 | −54.99 | −1.177 | −24.69 |
| 113 | −54.91 | −3.199 | −24.74 |
| 114 | −54.77 | −5.036 | −24.77 |
| 115 | −54.59 | −6.672 | −24.78 |
| 116 | −54.4 | −8.093 | −24.78 |
| 117 | −54.21 | −9.285 | −24.78 |
| 118 | −54.04 | −10.23 | −24.78 |
| 119 | −53.9 | −10.93 | −24.8 |
| 120 | −53.82 | −11.36 | −24.84 |
| 121 | −53.78 | −11.5 | −24.89 |
| 122 | −52.11 | −13.91 | −24.44 |
| 123 | −50.88 | −14.09 | −24.11 |
| 124 | −50.07 | −13.33 | −23.9 |
| 125 | −49.26 | −12.22 | −23.68 |
| 126 | −48.43 | −11.1 | −23.44 |
| 127 | −47.59 | −9.975 | −23.18 |
| 128 | −46.73 | −8.848 | −22.9 |

TABLE 1-continued

| No | X | Y | Z |
|---|---|---|---|
| 129 | −45.86 | −7.717 | −22.6 |
| 130 | −44.96 | −6.581 | −22.29 |
| 131 | −44.04 | −5.44 | −21.95 |
| 132 | −43.1 | −4.294 | −21.59 |
| 133 | −42.13 | −3.145 | −21.2 |
| 134 | −41.14 | −1.991 | −20.79 |
| 135 | −40.12 | −0.87 | −20.36 |
| 136 | −39.06 | 0.186 | −19.91 |
| 137 | −37.98 | 1.178 | −19.45 |
| 138 | −36.88 | 2.105 | −18.98 |
| 139 | −35.75 | 2.967 | −18.49 |
| 140 | −34.61 | 3.764 | −.18 |
| 141 | −33.45 | 4.495 | −17.49 |
| 142 | −32.28 | 5.161 | −16.98 |
| 143 | −31.1 | 5.761 | −16.46 |
| 144 | −29.91 | 6.297 | −15.94 |
| 145 | −28.71 | 6.768 | −15.41 |
| 146 | −27.52 | 7.175 | −14.88 |
| 147 | −26.32 | 7.518 | −14.36 |
| 148 | −25.13 | 7.799 | −13.83 |
| 149 | −23.94 | 8.017 | −13.31 |
| 150 | −22.76 | 8.191 | −12.78 |
| 151 | −21.57 | 8.339 | −12.25 |
| 152 | −20.38 | 8.461 | −11.71 |
| 153 | −19.18 | 8.556 | −11.16 |
| 154 | −17.98 | 8.623 | −10.6 |
| 155 | −16.77 | 8.663 | −10.04 |
| 156 | −15.56 | 8.675 | −9.474 |
| 157 | −14.34 | 8.658 | −8.901 |
| 158 | −13.31 | 8.611 | −8.323 |
| 159 | −11.88 | 8.533 | −7.739 |
| 160 | −10.63 | 8.422 | −7.152 |
| 161 | −9.368 | 8.276 | −6.559 |

Unit: mm

The axial flow fan according to the second embodiment of the invention is compared to the conventional axial flow fan about the degree of generating noise in the same amount of airflow as follows.

Figure 11:
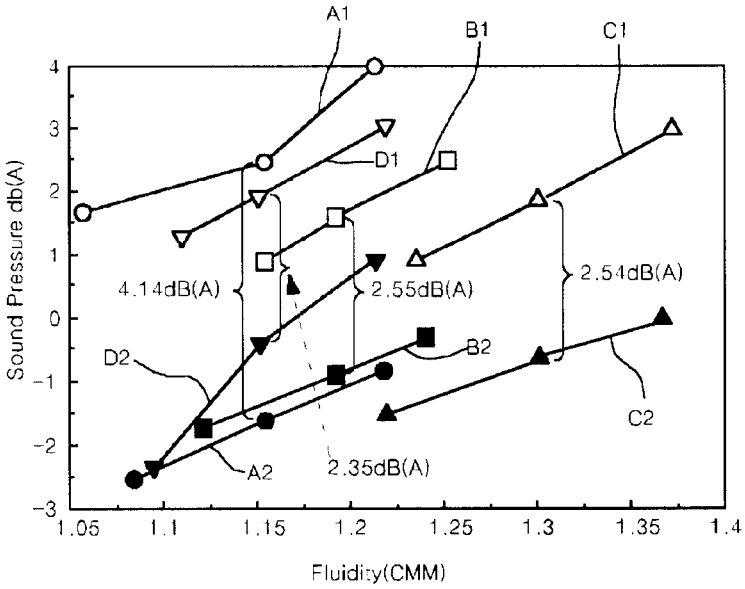
FIG. 11 is a graph for comparing noise variation of an axial flow fan of the invention with that of the related art.

First, FIG. 11 is a graph for illustrating noise variation according to model of the axial flow fan of the second embodiment of the invention and the conventional axial flow fan, in which the vertical axis indicates sound pressure and the horizontal axis indicates fluidity for comparing the axial flow fans of the invention to the related art according to capacity such as 140, 360, 420 and 500 liter.

As shown in FIG. 11, in 140 liter, the axial flow fan according to the second embodiment of the invention has a noise level lower than that of the related art for about 4.14 dB at the same amount of airflow. In 360 liter, the axial flow fan according to the second embodiment of the invention has a noise level lower than that of the related art for about 2.35 dB at the same amount of airflow, in 420 liter, lower for about 2.54 dB, and in 500 liter, lower for about 2.55 dB.

Therefore, the axial flow fan according to the second embodiment of the invention can reduce at least 2.5 dB of noise in average compared to the conventional axial flow fan in obtaining the same amount of airflow even if there are some differences according to model.

In this case, the rotation number of the axial flow fan according to the second embodiment of the invention is smaller of about 100 rpm than that of the conventional axial flow fan so that the same amount of airflow can be obtained in a low rotation velocity and thus the efficiency of the axial flow fan can be enhanced.

What is claimed is:

1. An axial flow fan for a condenser in a refrigerator, the axial flow fan comprising:

a hub; and three blades, wherein the diameter of the hub is 23.3±5% of an outside diameter of the axial flow fan and the a width of each of the blades is 36.6±3% of the outside diameter of the axial flow fan; and each of said blades has a maximum camber position of 0.65 which is uniformly distributed from the hub to a blade tip, wherein the maximum camber has curved distributions of 4.0 to 5.0% from the hub to the maximum camber position and of 5.0 to 6.0% from the maximum camber position to the blade tip.

2. The axial flow fan for a condenser according to claim 1, wherein the outside diameter of the axial flow fan is 150±1 mm, the diameter of the hub is 35±1 mm, and the width of the blades is 55±1 mm.

3. The axial flow fan for a condenser according to claim 1, wherein each blade has a pitch angle of 36.0 to 26.0° which is linearly distributed from the hub to the blade tip, and a sweep angle of 67.0°±5%.

4. An axial flow fan for a condenser in a refrigerator, the axial flow fan comprising:

a hub; and three blades, wherein a ratio of an inside diameter to an outside diameter is 23.0±5%, a maximum camber position is 0.65 uniformly distributed from the hub to a blade tip, and the maximum camber has curved distributions of 4.0 to 5.0% from the hub to the maximum camber position and of 5.0 to 6.0% from the maximum camber position to the blade tip.

5. The axial flow fan for a condenser according to claim 4, wherein each of the blades has a pitch angle of 35.0 to 24.0° which is linearly distributed from the hub to the blade tip and a sweep angle of 72.0 °±10% at the blade tip.

6. The axial flow fan for a condenser according to claim 4, wherein the outside diameter is 110±1 mm, a diameter of the hub is 25±1 mm, and a width of each of the blades is 36.0±1 mm.

7. The axial flow fan for a condenser according to claim 6, wherein each of said blades has a boundary divided into 160 areas from the hub-side front progressing clockwise, wherein a rotation axis of the axial flow fan is defined as the Z axis, the horizontal and vertical axes passing the Z axis are respectively defined as X and Y axes, wherein the areas have X, Y and Z coordinates according to the following table:

| No | X | Y | Z |
|---|---|---|---|
| 1 | −9.368 | 8.276 | −6.559 |
| 2 | −9.341 | 8.307 | −6.544 |
| 3 | −9.261 | 8.396 | −6.5 |
| 4 | −9.129 | 8.539 | −6.426 |
| 5 | −8.945 | 8.731 | −6.323 |
| 6 | −8.711 | 8.965 | −6.19 |
| 7 | −8.423 | 9.236 | −6.026 |
| 8 | −8.084 | 9.534 | −5.831 |
| 9 | −7.691 | 9.854 | −5.605 |
| 10 | −7.245 | 10.186 | −5.345 |
| 11 | −6.746 | 10.523 | −5.053 |
| 12 | −6.196 | 10.857 | −4.729 |
| 13 | −5.595 | 11.178 | −4.373 |
| 14 | −4.948 | 11.479 | −3.988 |
| 15 | −4.257 | 11.753 | −3.574 |
| 16 | −3.527 | 11.992 | −3.136 |
| 17 | −2.763 | 12.191 | −2.677 |
| 18 | −1.972 | 12.343 | −2.199 |
| 19 | −1.16 | 12.446 | −1.709 |
| 20 | −0.335 | 12.496 | −1.21 |
| 21 | 0.495 | 12.49 | −0.707 |

-continued

| No | X | Y | Z |
|---|---|---|---|
| 22 | 1.324 | 12.43 | −0.206 |
| 23 | 2.138 | 12.316 | 0.293 |
| 24 | 2.924 | 12.153 | 0.8 |
| 25 | 3.673 | 11.948 | 1.309 |
| 26 | 4.381 | 11.707 | 1.817 |
| 27 | 5.045 | 11.437 | 2.318 |
| 28 | 5.662 | 11.144 | 2.809 |
| 29 | 6.23 | 10.837 | 3.284 |
| 30 | 6.748 | 10.522 | 3.742 |
| 31 | 7.216 | 10.207 | 4.177 |
| 32 | 7.634 | 9.898 | 4.586 |
| 33 | 8.005 | 9.601 | 4.966 |
| 34 | 8.328 | 9.322 | 5.314 |
| 35 | 8.605 | 9.066 | 5.625 |
| 36 | 8.838 | 8.839 | 5.898 |
| 37 | 9.028 | 8.645 | 6.128 |
| 38 | 9.176 | 8.489 | 6.312 |
| 39 | 9.282 | 8.372 | 6.447 |
| 40 | 9.346 | 8.301 | 6.531 |
| 41 | 9.368 | 8.276 | 6.559 |
| 42 | 9.192 | 9.972 | 6.643 |
| 43 | 8.952 | 11.565 | 6.753 |
| 44 | 8.671 | 13.073 | 6.89 |
| 45 | 8.368 | 14.51 | 7.049 |
| 46 | 8.053 | 15.888 | 7.225 |
| 47 | 7.734 | 17.218 | 7.412 |
| 48 | 7.417 | 18.506 | 7.603 |
| 49 | 7.106 | 19.761 | 7.789 |
| 50 | 6.804 | 20.987 | 7.975 |
| 51 | 6.512 | 22.189 | 8.173 |
| 52 | 6.233 | 23.371 | 8.382 |
| 53 | 5.968 | 24.535 | 8.602 |
| 54 | 5.698 | 25.688 | 8.823 |
| 55 | 5.407 | 26.836 | 9.035 |
| 56 | 5.095 | 27.977 | 9.237 |
| 57 | 4.76 | 29.114 | 9.43 |
| 58 | 4.402 | 30.244 | 9.613 |
| 59 | 4.023 | 31.368 | 9.786 |
| 60 | 3.621 | 32.486 | 9.95 |
| 61 | 3.196 | 33.598 | 10.103 |
| 62 | 2.748 | 34.704 | 10.247 |
| 63 | 2.277 | 35.803 | 10.382 |
| 64 | 1.783 | 36.894 | 10.506 |
| 65 | 1.266 | 37.979 | 10.621 |
| 66 | 0.726 | 39.056 | 10.726 |
| 67 | 0.162 | 40.125 | 10.821 |
| 68 | −0.426 | 41.185 | 10.906 |
| 69 | −1.067 | 42.237 | 10.967 |
| 70 | −1.798 | 43.275 | 10.986 |
| 71 | −2.621 | 44.298 | 10.963 |
| 72 | −3.534 | 45.3 | 10.9 |
| 73 | −4.537 | 46.278 | 10.797 |
| 74 | −5.63 | 47.228 | 10.656 |
| 75 | −6.812 | 48.146 | 10.477 |
| 76 | −8.081 | 49.026 | 10.187 |
| 77 | −9.437 | 49.865 | 9.688 |
| 78 | −10.88 | 50.657 | 8.893 |
| 79 | −12.44 | 51.39 | 7.774 |
| 80 | −15.35 | 51.709 | 5.006 |
| 81 | −19.85 | 51.295 | −1.122 |
| 82 | −19.96 | 51.25 | −1.293 |
| 83 | −20.3 | 51.116 | −1.665 |
| 84 | −20.85 | 50.894 | −2.224 |
| 85 | −21.6 | 50.58 | −2.954 |
| 86 | −22.54 | 50.168 | −3.837 |
| 87 | −23.65 | 49.654 | −4.854 |
| 88 | −24.93 | 49.028 | −5.984 |
| 89 | −26.34 | 48.281 | −7.203 |
| 90 | −27.89 | 47.405 | −8.485 |
| 91 | −29.55 | 46.389 | −9.807 |
| 92 | −31.3 | 45.225 | −11.15 |
| 93 | −33.13 | 43.906 | −12.49 |
| 94 | −.35 | 42.423 | −13.8 |
| 95 | −36.91 | 40.773 | −15.07 |
| 96 | −38.83 | 38.953 | −16.28 |
| 97 | −40.73 | 36.962 | −17.39 |
| 98 | −42.59 | 34.805 | −18.41 |

-continued

| No | X | Y | Z |
|---|---|---|---|
| 99 | −44.38 | 32.485 | −19.31 |
| 100 | −46.09 | 30.017 | −20.09 |
| 101 | −47.67 | 27.442 | −20.8 |
| 102 | −49.1 | 24.783 | −21.47 |
| 103 | −50.38 | 22.064 | −22.07 |
| 104 | −51.5 | 19.307 | −22.61 |
| 105 | −52.46 | 16.537 | −23.08 |
| 106 | −53.25 | 13.778 | −23.49 |
| 107 | −53.88 | 11.056 | −23.82 |
| 108 | −54.36 | 8.395 | −24.1 |
| 109 | −54.69 | 5.819 | −24.31 |
| 110 | −54.9 | 3.351 | −24.48 |
| 111 | −54.99 | 1.012 | −24.61 |
| 112 | −54.99 | −1.177 | −24.69 |
| 113 | −54.91 | −3.199 | −24.74 |
| 114 | −54.77 | −5.036 | −24.77 |
| 115 | −54.59 | −6.672 | −24.78 |
| 116 | −54.4 | −8.093 | −24.78 |
| 117 | −54.21 | −9.285 | −24.78 |
| 118 | −54.04 | −10.23 | −24.78 |
| 119 | −53.9 | −10.93 | −24.8 |
| 120 | −53.82 | −11.36 | −24.84 |
| 121 | −53.78 | −11.5 | −24.89 |
| 122 | −52.11 | −13.91 | −24.44 |
| 123 | −50.88 | −14.09 | −24.11 |
| 124 | −50.07 | −13.33 | −23.9 |
| 125 | −49.26 | −12.22 | −23.68 |
| 126 | −48.43 | −11.1 | −23.44 |
| 127 | −47.59 | −9.975 | −23.18 |
| 128 | −46.73 | −8.848 | −22.9 |
| 129 | −45.86 | −7.717 | −22.6 |
| 130 | −44.96 | −6.581 | −22.29 |
| 131 | −44.04 | −5.44 | −21.95 |
| 132 | −43.1 | −4.294 | −21.59 |
| 133 | −42.13 | −3.145 | −21.2 |
| 134 | −41.14 | −1.991 | −20.79 |
| 135 | −40.12 | −0.87 | −20.36 |
| 136 | −39.06 | 0.186 | −19.91 |
| 137 | −37.98 | 1.178 | −19.45 |
| 138 | −36.88 | 2.105 | −18.98 |
| 139 | −35.75 | 2.967 | −18.49 |
| 140 | −34.61 | 3.764 | −.18 |

-continued

| No | X | Y | Z |
|---|---|---|---|
| 141 | −33.45 | 4.495 | −17.49 |
| 142 | −32.28 | 5.161 | −16.98 |
| 143 | −31.1 | 5.761 | −16.46 |
| 144 | −29.91 | 6.297 | −15.94 |
| 145 | −28.71 | 6.768 | −15.41 |
| 146 | −27.52 | 7.175 | −14.88 |
| 147 | −26.32 | 7.518 | −14.36 |
| 148 | −25.13 | 7.799 | −13.83 |
| 149 | −23.94 | 8.017 | −13.31 |
| 150 | −22.76 | 8.191 | −12.78 |
| 151 | −21.57 | 8.339 | −12.25 |
| 152 | −20.38 | 8.461 | −11.71 |
| 153 | −19.18 | 8.556 | −11.16 |
| 154 | −17.98 | 8.623 | −10.6 |
| 155 | −16.77 | 8.663 | −10.04 |
| 156 | −15.56 | 8.675 | −9.474 |
| 157 | −14.34 | 8.658 | −8.901 |
| 158 | −13.31 | 8.611 | −8.323 |
| 159 | −11.88 | 8.533 | −7.739 |
| 160 | −10.63 | 8.422 | −7.152 |
| 161 | −9.368 | 8.276 | −6.559 |

Unit: mm.

8. An axial flow fan for a condenser in a refrigerator, the axial flow fan comprising:

a hub; and three blades, wherein a ratio of an inside diameter to an outside diameter is 23.0±5%, a maximum camber position is 0.65 uniformly distributed from the hub to a blade tip, and the maximum camber has curved distributions of 4.0 to 5.0% from the hub to the maximum camber position and of 5.0 to 6.0% from the maximum camber position to the blade tip, wherein the axial flow fan is rotated clockwise or counterclockwise when viewed from the front.

* * * * *